United States Patent [19]

Buschmann et al.

[11] Patent Number: 4,726,699

[45] Date of Patent: Feb. 23, 1988

[54] NOISE ATTENUATION IN PRINTERS

[75] Inventors: Ulrich Buschmann, Elchingen; Guenter Gomoll, Nersingen/Leibi; Wolfgang Hauslaib, Langenau, all of Fed. Rep. of Germany

[73] Assignee: Mannesmann AG, Duesseldorf, Fed. Rep. of Germany

[21] Appl. No.: 927,659

[22] Filed: Nov. 5, 1986

[30] Foreign Application Priority Data

Nov. 6, 1985 [DE] Fed. Rep. of Germany ..... 3539290

[51] Int. Cl.[4] ..... B41J 29/08

[52] U.S. Cl. ..... 400/690; 181/201; 312/208

[58] Field of Search ..... 400/690, 689, 690.1, 400/691, 693; 181/201; 312/208

[56] References Cited

U.S. PATENT DOCUMENTS

| | | | |
|---|---|---|---|
| 1,876,640 | 9/1932 | Dobson | 400/691 |
| 2,126,326 | 8/1938 | Helmond | 400/689 |
| 4,215,762 | 8/1980 | Cunningham | 400/690.1 |

FOREIGN PATENT DOCUMENTS

| | | | |
|---|---|---|---|
| 842583 | 7/1960 | United Kingdom | 400/691 |

OTHER PUBLICATIONS

IBM Technical Disclosure Bulletin, vol. 26, No. 1, Jun. 1983.

*Primary Examiner*—Edgar S. Burr
*Assistant Examiner*—Huong Q. Pham
*Attorney, Agent, or Firm*—Ralf H. Siegemund

[57] ABSTRACT

Sound attenuation for a printer which includes impacting print elements and other movable noise producing parts being mounted to a frame and further including a biparted housing; the frame bottom having downwardly extending feet by means of which the printer rests on a support surface; the housing envelops the frame and is provided with openings through which the feet project without touching the print housing; the housing is floatingly suspended on said frame through a plurality of connections each of which includes pins integral with the frame and being circumscribed by an attenuating sleeve which is being connected to the frame by a locking cap seated on the respective pin for holding down the sleeve.

7 Claims, 5 Drawing Figures

NOISE ATTENUATION IN PRINTERS

BACKGROUND OF THE INVENTION

The present invention relates to a printer, particularly a matrix printer with impact producing print elements, arranged in a noise reducing case under the assumption that any movable part in the case is prone to produce noise. Moreover, it is assumed that the mechanically moving parts are mounted in some fashion to a frame.

Printers of the type to which the invention pertains, are used in some form as on-line printers in public or private places. They are used, for example, in conjunction with cash registers, in banks, near teller stations, in various forms of offices, in travel agencies, for example, for printing tickets, or the like. They are used for printing various kinds of documents, such as cash receipts, encoded documents or the like. It is also well known that many of these printers produce a high pitch rather annoying sound, not unlike a high speed saw or the like. If such a printer, for example, is used in an office, especially in conjunction with a word processor or the like, it is usually intolerable if the noise produced, particularly by more than one of these printers, exceeds a certain level, e.g. 55 dB. Stranger noise will definitely interfer with the concentration of other workers or even of the worker operating the printer.

Generally speaking, printers cause such noise for a variety of reasons. The basic reason is that the impacting print elements, the moving parts of the print mechanism generally, including, for example, a carriage on which the print elements are mounted, or the like, set up oscillations and vibrations in and of various parts with which they come in contact, the noise is, of course, produced inside the printer, and encasing the printer has, from an overall point of view, some noise attenuating effect, but practice has shown that a cover or the like is not sufficient, particularly if more than one printer is in the same room. Also, and depending upon the environment of the printer, it may well happen that it stands in some particular location which often for unforeseeable reasons is prone to undergo sympathetic resonance vibrations or the like. In fact, the particularly way of placing a printer may tend to actually increase the noise it produces even in those cases in which there is a cover.

It is immediately obvious that the impact producing elements (hammer styli, etc.) produce noise just by virtue of the respective impact. However, there are other though related noise sources. One has to cope here with a variety of characteristic resonance frequencies of and in the printer, particularly of various parts thereof, of the frame, of the mechanisms as a whole, or of groups of elements which are interconnected in a compact fashion. Interconnected parts form an element which is mounted in some fashion inside the printer. The parts themselves and the interconnected unit each may undergo their own vibrations. These vibrations, whatever their original sources, may emerge into the ambient air from inside the housing; they may propagate as noise immediately and directly from the point of production. However, if the source is a point, it has to be observed that the vibrations are propagating through solid parts and emerge in different locations including the outside, as far as the casing is concerned. In the case of sympathetic vibrations relatively large parts vibrate as a whole and anything they hit sets up additional noise etc.

Generally speaking, a printer is constructed such that there is a frame to which all or most parts are connected. The frame is mounted in a printer housing. These two parts, namely the housing and the frame, are bolted together and the entire unit may be placed on some support surface. For example, rubber, or any other sound attenuating feet may be provided on the other side of the housing by means of which the printer is then placed onto whatever support surface is available.

This is the general background, and has to be taken into consideration if one attempts to provide for any noise abatement and noise attenuation.

DESCRIPTION OF THE INVENTION

It is an object of the present invention to generally reduce the noise produced in printers, using impact producing print elements, with the goal in mind that the noise reduction should not just be reduced to be merely tolerable within usual, or even other limits such as prescribed by law, but should be reduced well below 50 dB.

In accordance with the preferred embodiment of the present invention, it is suggested that the frame of the printer carrying the print mechanism, including the impact producing print elements and support parts thereof, is provided directly with feet by means of which the printer is then placed onto the particular support surface, and that these equipment feet penetrate or pass through the printer housing without engaging the housing, there being openings in the housing accordingly, and that furthermore in any of the connections by means of which that frame is connected to the housing, a sound attenuating element is provided. This way, noise is generally kept away from the printer housing, which means that noise is no longer directly introduced into the housing through any solid transmission path, so that the housing itself is not immediately excited by vibrations. Consequently, the housing no longer serves as an immediate noise generator towards the ambient. At the most, certain noise is just transmitted from some point inside the case, through air in the case, the case wall towards the outside, but in that capacity the case or housing serves by and in itself as a sound attenuating structure. From an overall point of view, it was found that by this relatively simple feature, the noise level outside the housing is, in fact, well below 50 dB.

The connection between the frame and the casing establishes a single (mass) unit oscillator, so that owing to the known laws about oscillations and vibrations and involving resonance frequency generally, this system determines a resonance frequency on the basis of simple spring-mass equivalent relationships. Accordingly, the system can be tuned such that very little sound is, in fact, introduced into the support surface. The aforementioned attenuating elements, which are par. of the frame-housing connection, should be very soft, as far as connecting the frame and the case or housing is concerned. This, in fact, reduces the resonance frequency of the frame-housing system which, in turn, has a significant effect on the overall noise attenuation.

In accordance with a further feature of the present invention, the connection between printer frame and printer housing or case is a kind of suspendsion which may include a connecting pin on the frame, and an attenuating sleeve surrounding this pin and being, in turn, connected to the frame. A latch cap is stuck onto the pin. This way then a kind of floating suspension is provided but still the frame with all the parts connected to it, can easily be disassembled and re-assembled which, of course, is also significant for the maintainance involved with the printer operation.

A further feature of the present invention is to be seen in that the respective connecting pins are, in fact, an integral part of the printer housing or case, is hollow in its interior, and has spreading arms. The attenuating element is provided with a peripherally extending groove by means of which it is connected in and to a rim delineating somewhat smaller opening in the frame. In this case then, the manufacturing costs are significantly reduced and quite low.

In accordance with a further feature of the invention, it is suggested to bipart the housing, there being an upper housing part and a lower housing part, accordingly, which parts can be separated from each other. There is a separation gap between these housing parts and by means of a ceiling cord or string, these parts are sealed in relation to each other. This feature guarantees a fairly soundproofing sealing of the housing which, in fact, amounts to an encapsulation retaining any noise inside the printer as much as possible. This sealing strip, moreover, can take up any manufacture tolerances as they exist when the upper and lower housing parts are separately made.

Every printer, of course, has to be provided with some kind of feed opening for the paper which passes through the printer itself. Also, certain venting openings for cooling air are necessary. It is of advantage to provide just the lowest part of the casing with venting slots and all these bottom openings are circumscribed by sound attenuating skirting structure.

DESCRIPTION OF THE DRAWINGS

While the specification concludes with claims particularly pointing out and distinctly claiming the subject matter which is regarded as the invention, it is believed that the invention, the objects and features of the invention and further objects, features, and advantages thereof, will be better understood from the following description taken in connection with the accompanying drawings in which:

Figure 1:
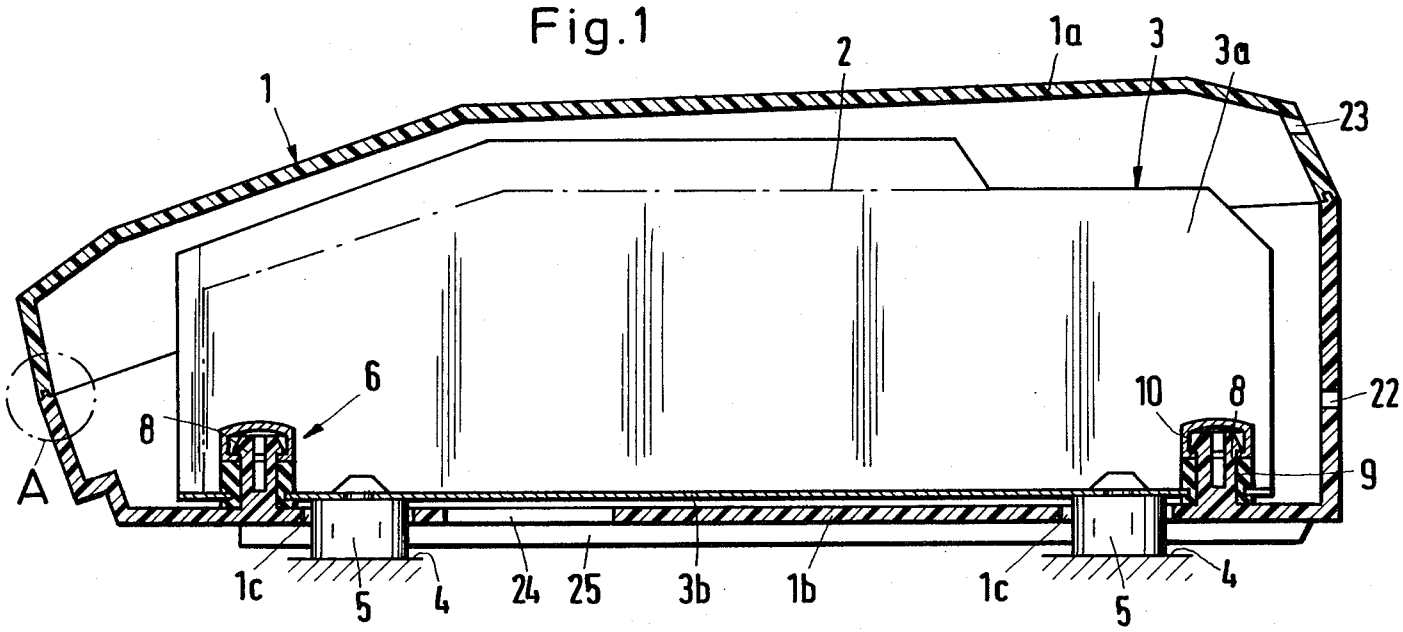
FIG. 1 is a vertical cross-section through a matrix printer, including particularly the housing and the frame, however, the various mechanical parts connected to the frame and constituting the printer structure proper have been omitted.
Figure 2:
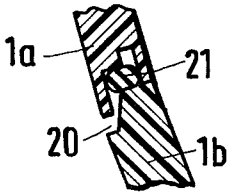
FIG. 2 is a cross-section through a seal between the upper and the lower housing part, the figure is drawn on an enlarged scale as compared with FIG. 1, and the letter A in FIG. 1 indicates the location of that detail.

Proceeding now to the detailed description of the drawings, the printer illustrated in FIG. 1, is assumed to be a matrix printer which includes a reciprocating print head carrying needles, styli or hammers, and being moved past a print medium carrier during printing operation. These parts are collectively designated 2, and are not further shown. The printer case or housing 1 illustrated includes an upper part 1*a* and a lower part 1*b*. The print mechanism 2 furthermore includes a paper guide, a paper transport structure drive, and a guiding structure for the print head, the drives for the print needles, and the like.

The printer case or housing 1 can be seen to envelope the printer structure in its entirety, and is, therefore, by and in itself a sound attenuating device. The print mechanism 2, i.e. the parts making up that mechanism, is mounted to a metallic frame 3. This frame 3 in the essence is comprised of two parts 3*a* and 3*b*, wherein the frame part 3*a* constitutes all of the sides, and 3*b* is a frame bottom. The print casing as a whole, contrary to any structure of known configuration, does not sit directly on a support surface 4, indicated generally in a schematic fashion. Rather, the bottom part 3*b* of the frame 3 is provided with feet 5, made, for example, from elastic material such as rubber. The printer sits on the ground floor by means of these feet. The weight of the printer is taken up by three or four of these feet 5. The feet 5 project clearingly through openings 1*c* in the bottom part 1*b* of the housing. It is an important feature that these feet 5 do not engage or otherwise contact the housing 1. The print housing 1 is suspended on the bottom part 3*b* of the frame in a floating fashion, to be described as follows.

Print frame 3 is provided with connections 6, spaced to some extent from the feet 5. These connections 6 are provided more specifically, between the casing bottom 1*b* and the print frame 3. Each of these connections 6 contains a noise attenuating sleeve 7 being connected so as to be a load and weight carrying part as between the housing and the frame. The attenuating sleeve 7 is quite soft so that the term "floating suspension" is appropriate. This way one obtains quite an advantageous sound attenuation; in particular, the propagation i.e. transmission of sound from the frame into the housing itself is impeded i.e. largely prevented.

The connection 6 specifically includes a connecting pin 8 which is integral with the housing bottom part 1*b*; together they are injection molded or the like, and made of a plastic or synthetic. The attenuating sleeve 7 is made of an elastic material and circumscribes the pin 8. On the pin 8, moreover, is provided a locking cap 10 to be explained more fully with reference to FIGS. 3, 3*a*, and 3*b*.

Figure 3:
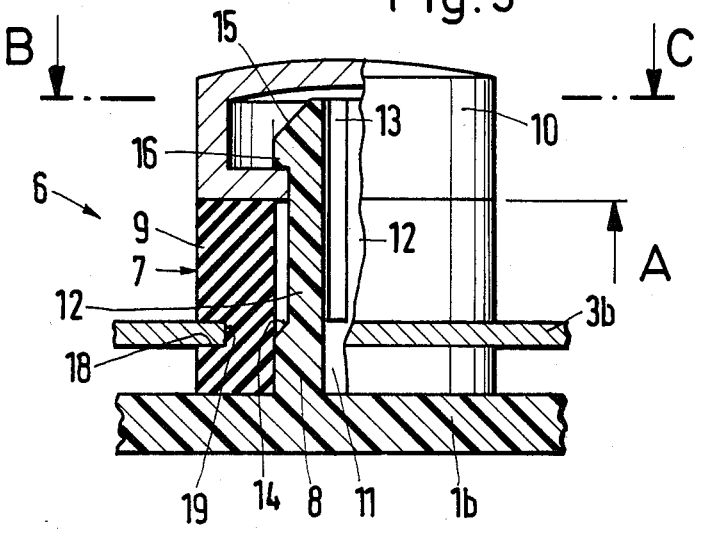
FIG. 3 is also an enlarged view of another detail involving the connection between frame and housing or casing of the printer.
Figure 3A:
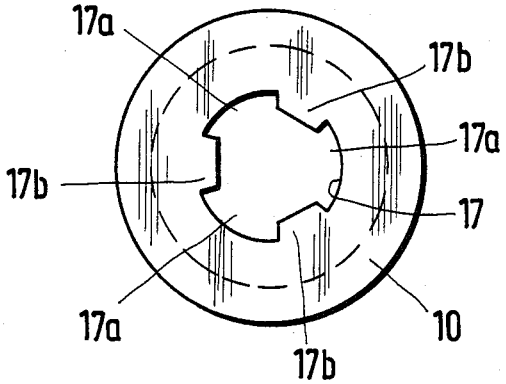
FIG. 3*a* is a view, as indicated by arrow A in FIG. 3, and involving the locking cap as seen towards the underside.
Figure 3B:
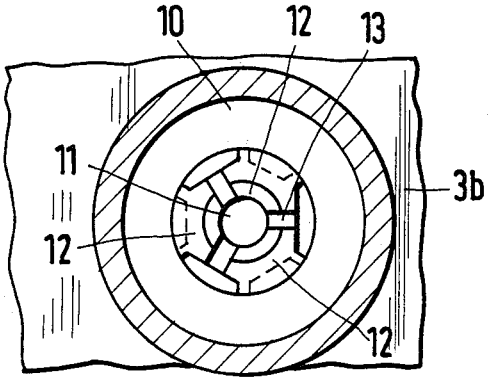
FIG. 3*b* is a horizontal section as indicated by lines and arrows B, C, in FIG. 3, the section being taken also through the locking cap.

FIGS. 3, 3*a*, and 3*b* illustrate details of the connection 6. The connecting pin 8, as stated, is integral with the housing part 1*b*. Pin 8 is hollow in its interior and establishes the hollow cavity 11. Moreover, the sleeve establishes spreading arms 12 in that there are radial slots 13, as shown specifically in FIG. 3*b*. The resilient spring-like action of the spreading arms 12 is increased, moreover, through steps 14 (FIG. 3). A bevelled nose 16 is provided at the peak of the sleeve 8. This, of course, is true for each of the arms. Each of these noses 16 are gripped around by the cap 10. Particularly the locking cap 10 is provided with an opening 17, the configuration of which can be particularly seen in FIG. 3*a*.

Each of the three spring arms is associated with a radially larger portion 17*a* of opening 17 adjacent to which are locking lugs 17. Upon axial slip-on of the cap 10, the noses 16 will pass through 17*a* are the cap is turned the radially narrower lugs 17*b* grip, respectively, under the noses 16 so that, thereby, they axially lock the cap 10. In this way now, one obtains a resilient connection between the printer housing 1 as a whole, and the lower housing part 1*b* in particular with the bottom part 3*b* of the printer frame 3.

The attenuating element 7 is constructed as a round attenuating sleeve and is provided on its outer periphery with a groove 18. The sleeve 7 projects through a smaller opening 19 in frame 3*b* and an edge or rim portion of the frame bottom 3*b* grips into that groove 18.

Turning now to the particulars of the housing construction and here particularly to a dual configuration of an upper and lower casing part, there is provided a separating gap 20 in-between them. Within the separating gap 20 is provided a sealing rope, cord, or the like 21, so that sound will not pass through that gap in the housing. On the other and, the gap and partitioning of the housing permits easy disassembly, and the two housing parts should be separated for ease of access. This means that, for example, only the upper part is being lifted in case certain simple maintenance aspects have to be taken car of.

The lower part 1*b* of the housing is provided with a paper feed opening 22, for the paper to be used by the printer. Another opening 23 is provided for withdrawal of the paper that has been printed on. During passing through of the paper, it is inevitable that some sound leaves through the openings 22 and 23 from the interior of the printer housing. Moreover, another aspect to be considered is that the electrical components inside the printer casing 1, such as motor, switches, circuit boards, and the like, require cooling. Therefore, cooling slots 24 are provided also in the lower housing part 1*b*. Also here then noise can emanate from the interior of the housing.

The noise which tends to leave the lower housing part 1*b* through these openings is now attenuated by a skirt 25 which extends around the bottom of the lower casing part 1*b* and along at least three sides.

The inventive sound attenuating features were found to readily meet minimum requirement for the sound attenuation at a given work place. These requirements are set forth in DIN 45635, part 19, corresponding to ISO 7779, and the improvement over these minimum requirements obtained by means of the invention are at least 16 dB(A).

The invention is not limited to the embodiments described above, but all changes and modifications thereof, not constituting departures from the spirit and scope of the invention are intended to be included.

What is claimed is:

1. In a printer which includes impacting print elements operated with a high degree of periodicity and other movable noise producing parts being mounted to a frame and further including a housing or case, the improvement comprising:

said frame carrying noise producing components, including the impacting print elements operated with a high degree of periodicity, said frame being provided with a plurality of downwardly extending feet by means of which the printer rests on a support surface;

said housing circumscribing and enveloping said frame, and having a bottom being provided with a plurality of openings through which respectively said feet project without contacting and engaging the bottom of said print housing; and means for floatingly suspending said housing on said frame and above and out of contact with said support surface including a plurality of connections each of which includes a sound propagation impeding and attenuating element.

2. The improvement as in claim 1, wherein said floating connection is provided through a plurality of connecting pins on said housing, each of said pins being circumscribed by a sound attenuating sleeve serving as said element, the sleeve in turn being connected to said frame; and a locking cap seated on the respective pin for holding down said sleeve.

3. The improvement as in claim 2, wherein said pins are one piece integral with said housing.

4. The improvement as in claim 2, wherein said pins each are hollow and slotted to obtain spreadable arms.

5. The improvement as in claim 1, wherein each attenuating element is provided with a peripheral groove, and being fastened to a round opening in the frame, the opening including rim means projecting into the groove.

6. The improvement as in claim 1, wherein said housing is biparted to obtain an upper and a lower casing part, there being a sealing element interposed in a gap as defined in-between the upper and lower housing part.

7. The improvement as in claim 1, there being a sound attenuating skirt extending from the bottom of said housing down and around most of the bottom of the housing.

* * * * *